US011771943B2

(12) United States Patent
Schatz et al.

(10) Patent No.: US 11,771,943 B2
(45) Date of Patent: Oct. 3, 2023

(54) HOLDING DEVICE FOR USING GYM EQUIPMENT

(71) Applicants: Ralph Schatz, Waidhofen an der Ybbs (AT); Stefan Riegler, St. Martin/Traun (AT); Eric Kaltenbrunner, Luftenberg (AT); Matthias Riegler, Schwertberg (AT)

(72) Inventors: Ralph Schatz, Waidhofen an der Ybbs (AT); Stefan Riegler, St. Martin/Traun (AT); Eric Kaltenbrunner, Luftenberg (AT); Matthias Riegler, Schwertberg (AT)

( * ) Notice: Subject to any disclaimer, the term of this patent is extended or adjusted under 35 U.S.C. 154(b) by 173 days.

(21) Appl. No.: 17/433,939

(22) PCT Filed: Feb. 14, 2020

(86) PCT No.: PCT/AT2020/000002
§ 371 (c)(1),
(2) Date: Aug. 25, 2021

(87) PCT Pub. No.: WO2020/172695
PCT Pub. Date: Sep. 3, 2020

(65) Prior Publication Data

US 2022/0134174 A1 May 5, 2022

(30) Foreign Application Priority Data

Feb. 27, 2019 (AT) ..... 73/2019
Jul. 1, 2019 (AT) ..... 240/2019

(51) Int. Cl.
*A63B 21/065* (2006.01)
*A63B 21/072* (2006.01)
*A63B 21/00* (2006.01)

(52) U.S. Cl.
CPC ..... *A63B 21/4019* (2015.10); *A63B 21/065* (2013.01); *A63B 21/072* (2013.01);
(Continued)

(58) Field of Classification Search
CPC ..... A63B 21/0004; A63B 21/00061; A63B 21/0618; A63B 21/065; A63B 21/068;
(Continued)

(56) References Cited

U.S. PATENT DOCUMENTS 4,351,526 A 9/1982 Schwartz
4,521,011 A * 6/1985 Solloway ..... A63B 31/14 441/59

(Continued)

FOREIGN PATENT DOCUMENTS

CN 205145487 U 4/2016
DE 202008014283 U1 4/2009

OTHER PUBLICATIONS

International Search Report for PCT/AT2020/000002, Prepared by the European Patent Office, dated May 15, 2020, 7 pages including translation.

*Primary Examiner* — Joshua Lee
(74) *Attorney, Agent, or Firm* — BROOKS KUSHMAN PC; John E. Nemazi

(57) ABSTRACT

A holding device for using gym equipment for the purpose of muscle building training. The holding device has a handle part and a bracket, and the hand of a person using the holding device can be inserted between the handle part and the bracket. The hand side of the handle part is convexly curved with the exception of local depressions and/or perforations, and parts for releasably securing a dumbbell plate can be releasably secured to the lower face of the handle part. The hand side of the handle part has four groove-shaped depressions which are dimensioned and spaced from (Continued)

Figure 1:
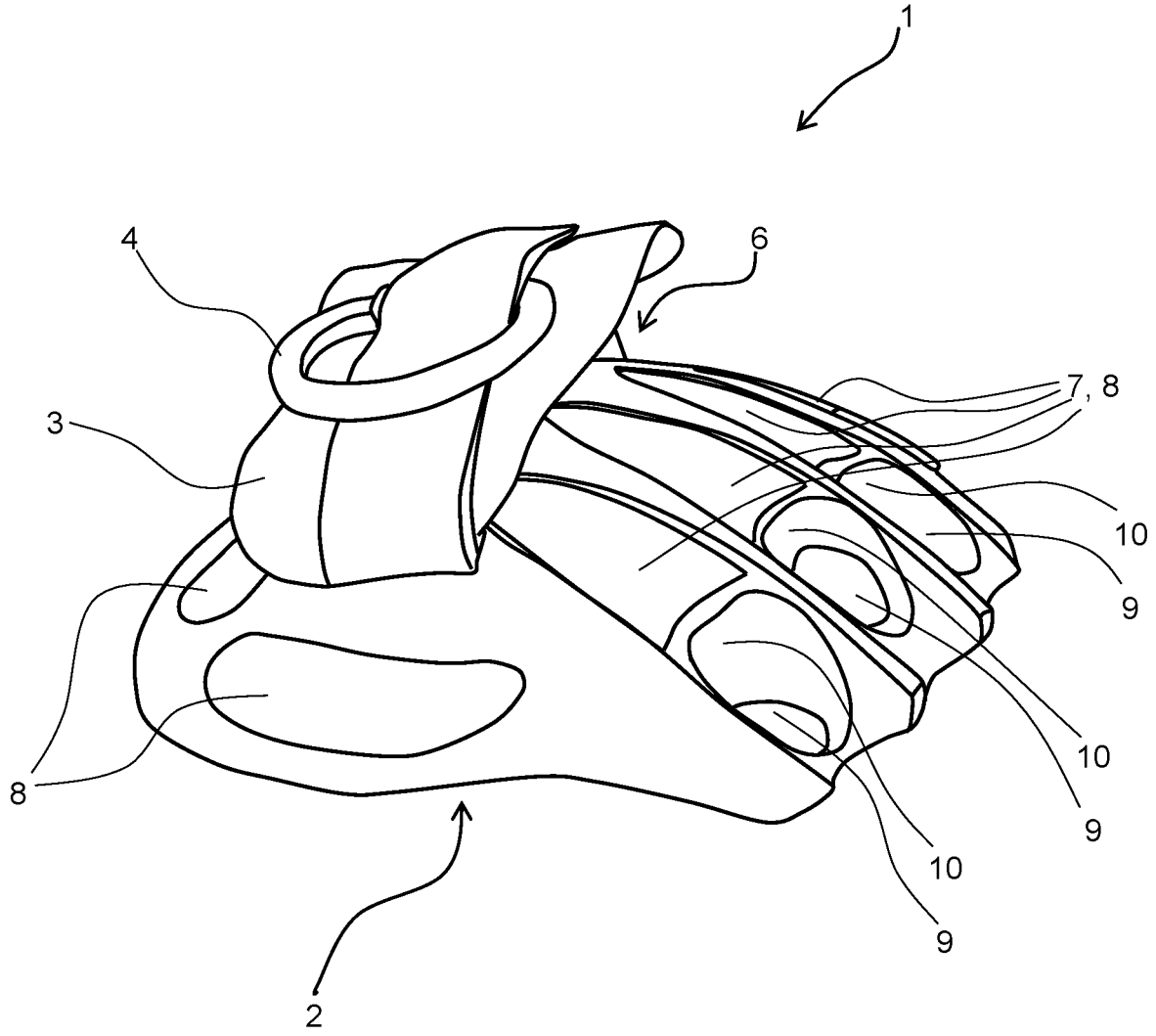

one another such when using the holding device as intended with a hand placed on the hand side, each finger is positioned in a respective depression of the groove-shaped depressions with the exception of the thumb.

10 Claims, 7 Drawing Sheets

(52) U.S. Cl.
CPC ..... *A63B 21/4021* (2015.10); *A63B 21/4035* (2015.10); *A63B 21/4039* (2015.10)

(58) Field of Classification Search
CPC . A63B 21/072; A63B 21/0726; A63B 21/075; A63B 21/4019; A63B 21/4021; A63B 21/4025; A63B 21/4035
See application file for complete search history.

(56) References Cited

U.S. PATENT DOCUMENTS 4,770,409 A * 9/1988 Wallisch ..... A63B 21/4035 482/45
5,993,362 A 11/1999 Ghobadi
6,183,400 B1 * 2/2001 Pope ..... A63B 21/4019 74/551.8
6,482,168 B1 * 11/2002 Betcher ..... A61F 5/0118 128/878
9,022,906 B1 5/2015 Nelson
9,079,092 B2 * 7/2015 Stack ..... A63B 69/004
9,844,695 B1 12/2017 Shorter
11,260,264 B2 * 3/2022 Richter ..... A63B 21/4021
2007/0049473 A1 3/2007 Chapman et al.
2009/0275447 A1 11/2009 Fishman et al.
2010/0144501 A1 6/2010 Berhanu
2010/0210423 A1 * 8/2010 Nieusma ..... A63B 21/0004 482/50
2010/0216615 A1 * 8/2010 Rios ..... A63B 22/203 482/142
2013/0123072 A1 * 5/2013 Marji ..... A63B 21/00065 482/44
2014/0038784 A1 * 2/2014 Wallisch ..... A63B 23/03541 482/46
2014/0207039 A1 7/2014 Lane
2017/0296864 A1 10/2017 Richter et al.
2019/0366180 A1 * 12/2019 Waffensmith ..... A63B 69/0026
2021/0023415 A1 * 1/2021 Richter ..... A63B 21/4035

* cited by examiner

HOLDING DEVICE FOR USING GYM EQUIPMENT

CROSS-REFERENCE TO RELATED APPLICATION

This application is the U.S. national phase of PCT Application No. PCT/AT2020/000002 filed on Feb. 14, 2020, which claims priority to AT Patent Application No. A 73/2019 filed on Feb. 27, 2019, and AT Patent Application No. A 240/2019 filed on Jul. 1, 2019, the disclosures of which are incorporated in their entirety by reference herein.

The invention relates to a holding device for using gym equipment for the purpose of bodybuilding training.

DE 20 2008 014283 U1 discloses a holding device for holding a weight plate. The holding device comprises a substantially planar gripping part, a strap and a bolt stub, wherein the bolt stub protrudes from a main surface of the gripping part and the strap is located on the side facing away from the bolt stub and stands out regionally from the gripping part. When the device is used as intended, a person puts a hand between the strap and the gripping part such that the gripping part rests, with its outer surface, which has a convex shape there, against the palm and is grasped by the hand. The bolt stub extends into the central opening of a circular weight plate and the weight plate is fixed to the bolt stub. Optionally, it is also possible for two such holding devices to be used, the bolt stubs of which project into the central opening of a weight plate from opposite sides.

The problem addressed by the invention is that of improving the principle known from DE 20 2008 014283 U1 to such an extent that there are fewer restrictions with regard to directions and magnitudes of those forces that can be transmitted comfortably between the holding device and a human hand holding the latter as intended. Thus, the range of directions and magnitudes of those forces that are comfortably transmissible between the hand and holding device is intended to be expanded in order that, using the holding device, a wider range of gym exercises is enabled and exercises can be maintained for longer and/or repeated more often without pain. Not least, the holding device should, in addition to the holding of weight plates, also support the operation of other gym equipment, in particular cable pulls and resistance bands.

To solve the problem, the design according to DE 20 2008 014283 U1 is used as a starting point. As main improvement according to the invention, it is proposed that that surface of the planar gripping part on which a hand of the person using the holding device rests when the device is used as intended be equipped with four channel-like recesses which, when the device is used as intended, extend parallel to the index finger, middle finger, ring finger and little finger of the hand and are dimensioned and spaced apart from one another such that a respective one of these fingers fits in a respective one of these channel-like recesses.

As a result of this measure, which is easy to realize, especially forces that are intended to be transmitted between the gripping part and the hand and notably have force components that are oriented substantially parallel to the palm and substantially normally to said fingers can be transmitted very readily, specifically without extreme local pressure maxima and without rubbing.

In a particularly preferred embodiment, the channel-like recesses each end, at their end located, as intended, away from the palm, in a hole-like recess, the boundary surface of which that faces the rest of the longitudinal region of the channel-like recesses is oriented approximately normally to the intended contact face of the gripping part with a weight plate held thereby.

The invention is illustrated, including further advantageous optional additional features, by way of drawings.

FIG. 1: shows an example of a holding device 1 according to the invention with a viewing direction obliquely onto that surface of the gripping part 2 of the holding device on which the left-hand palm of a person rests when the device is used as intended.

Figure 2:
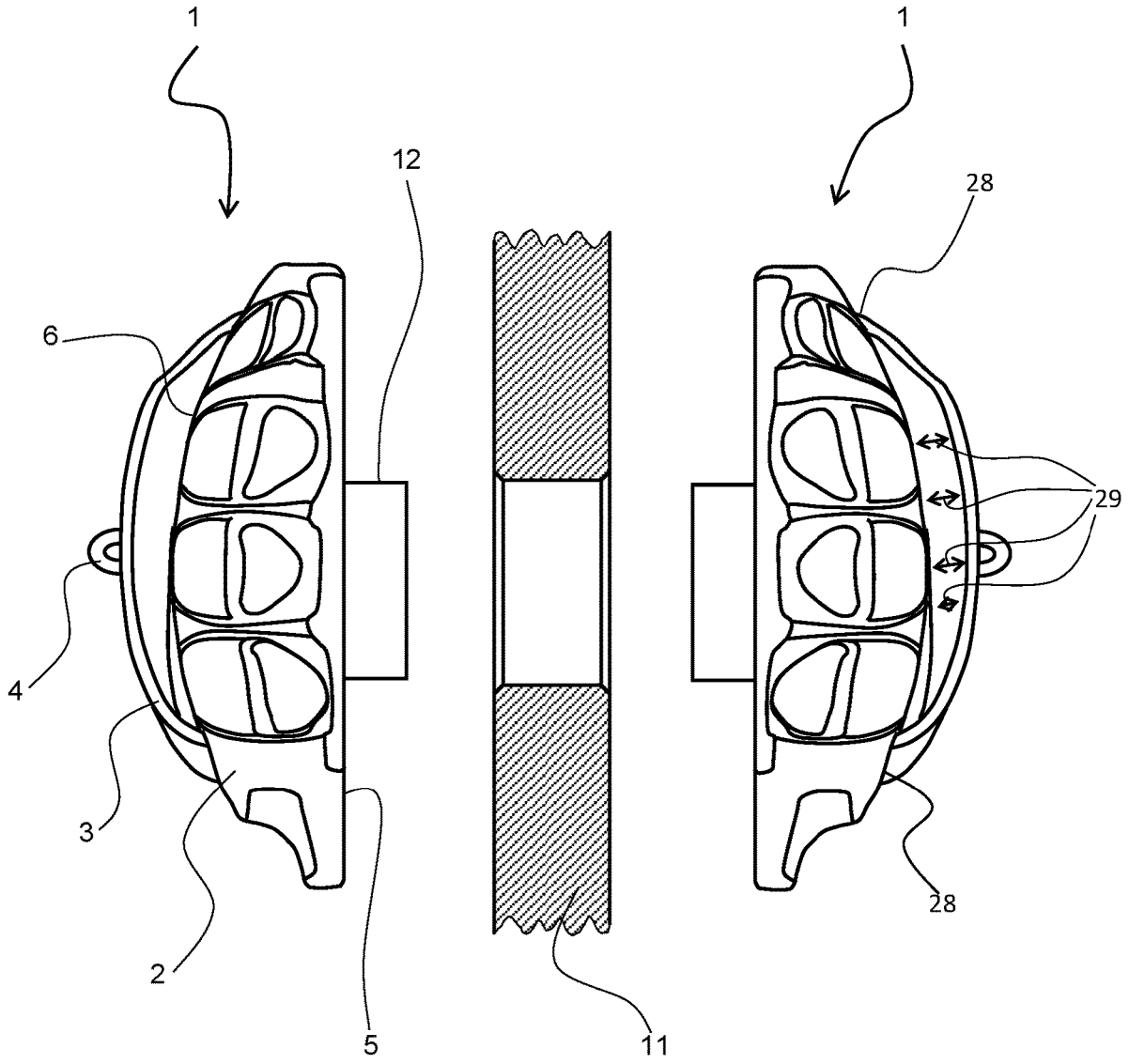

FIG. 2: shows an exploded illustration of a weight plate in a sectional side view and both the holding device 1 from FIG. 1 and also a mirror-inverted holding device in each case in side view with a viewing direction onto that region of the respective gripping part 2 on which the fingertips of a person using the holding device 1 rest when the device is used as intended.

Figure 3:
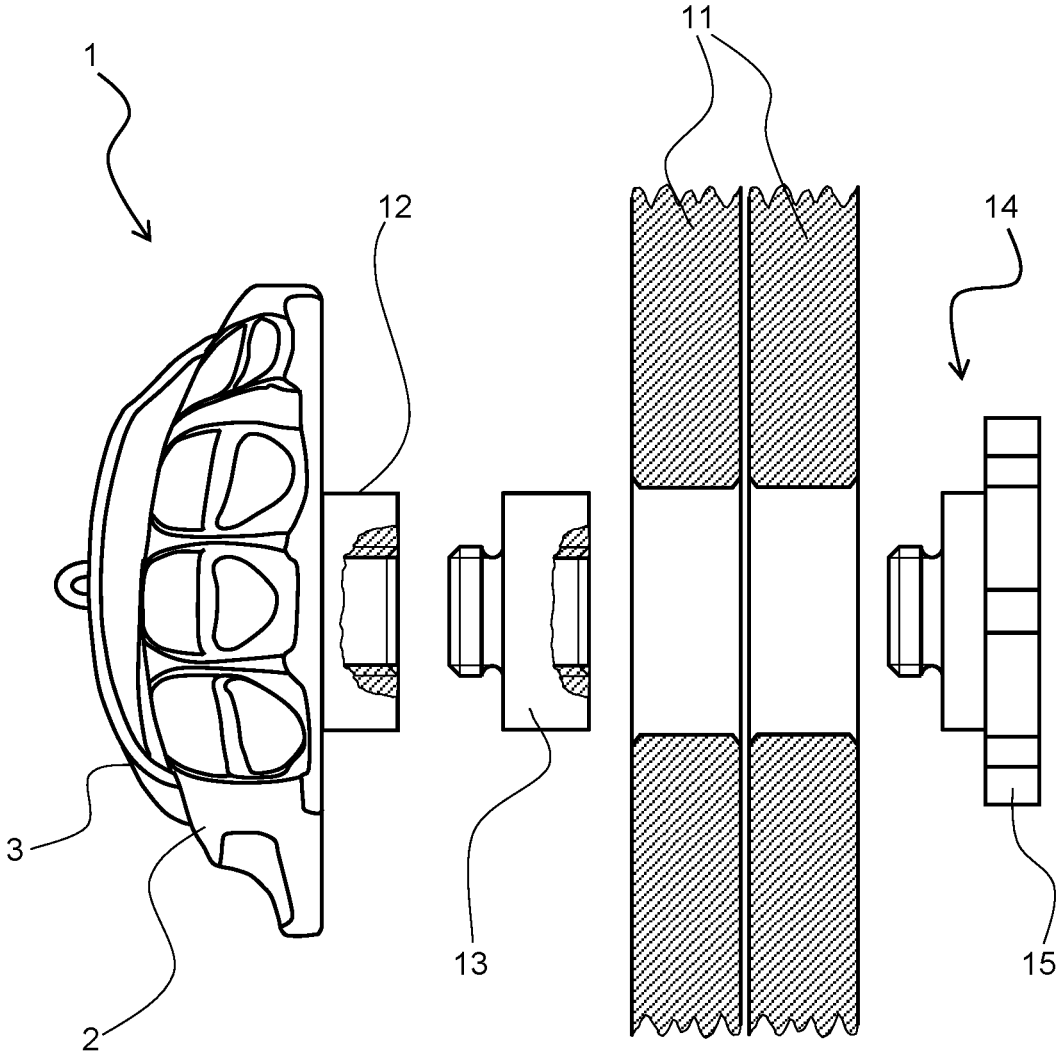

FIG. 3: shows an exploded illustration of the holding device 1 from FIG. 1 and also two weight plates and auxiliary parts of the holding device that are used for holding the weight plates.

Figure 4:
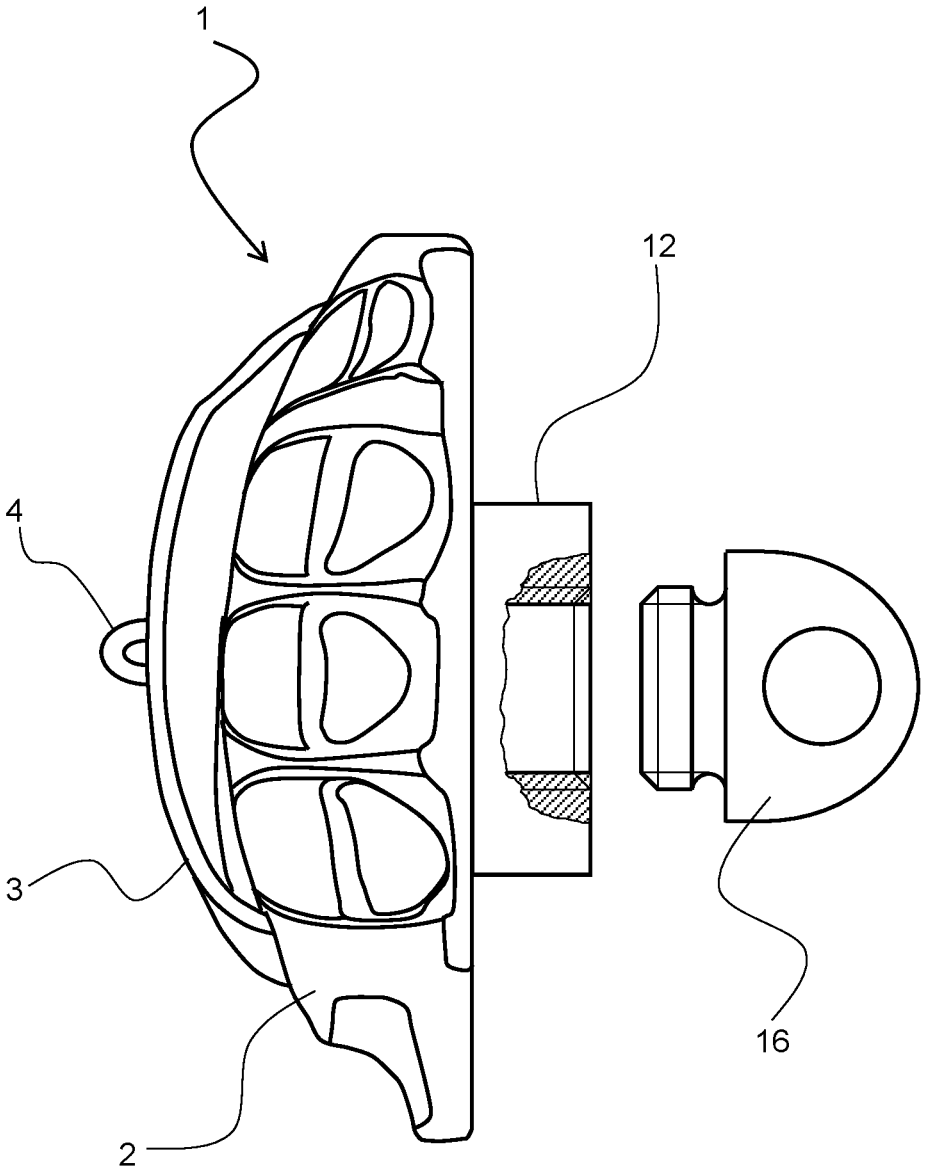

FIG. 4: shows an exploded illustration of the holding device 1 from FIG. 1 and also auxiliary parts for connecting to pulling means such as cables or bands.

Figure 5:
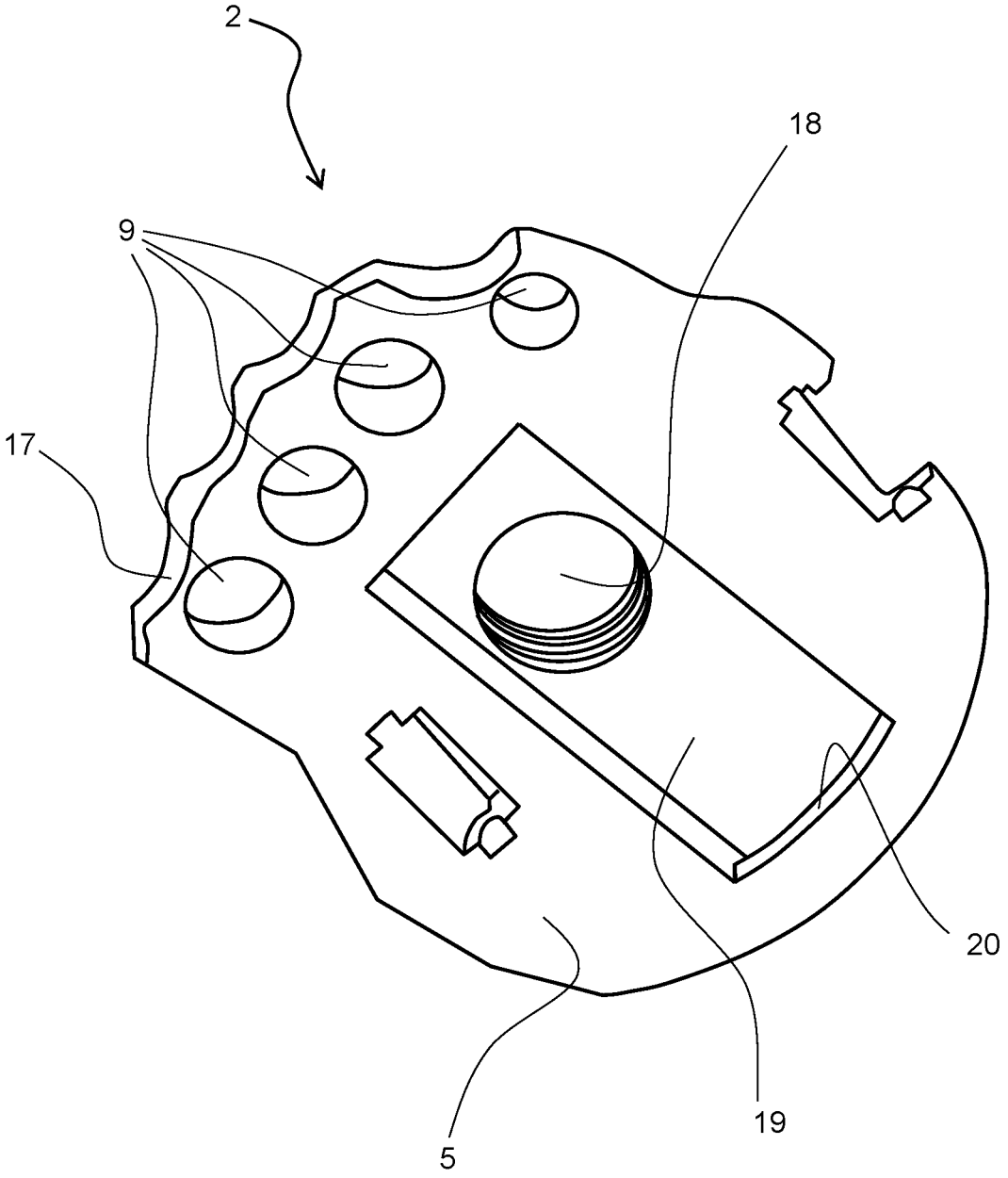

FIG. 5: shows an oblique view of that side ("underside") of the gripping part of the holding device 1 from FIG. 1 that faces away from the palm of the left hand when the device is used as intended.

Figure 6:
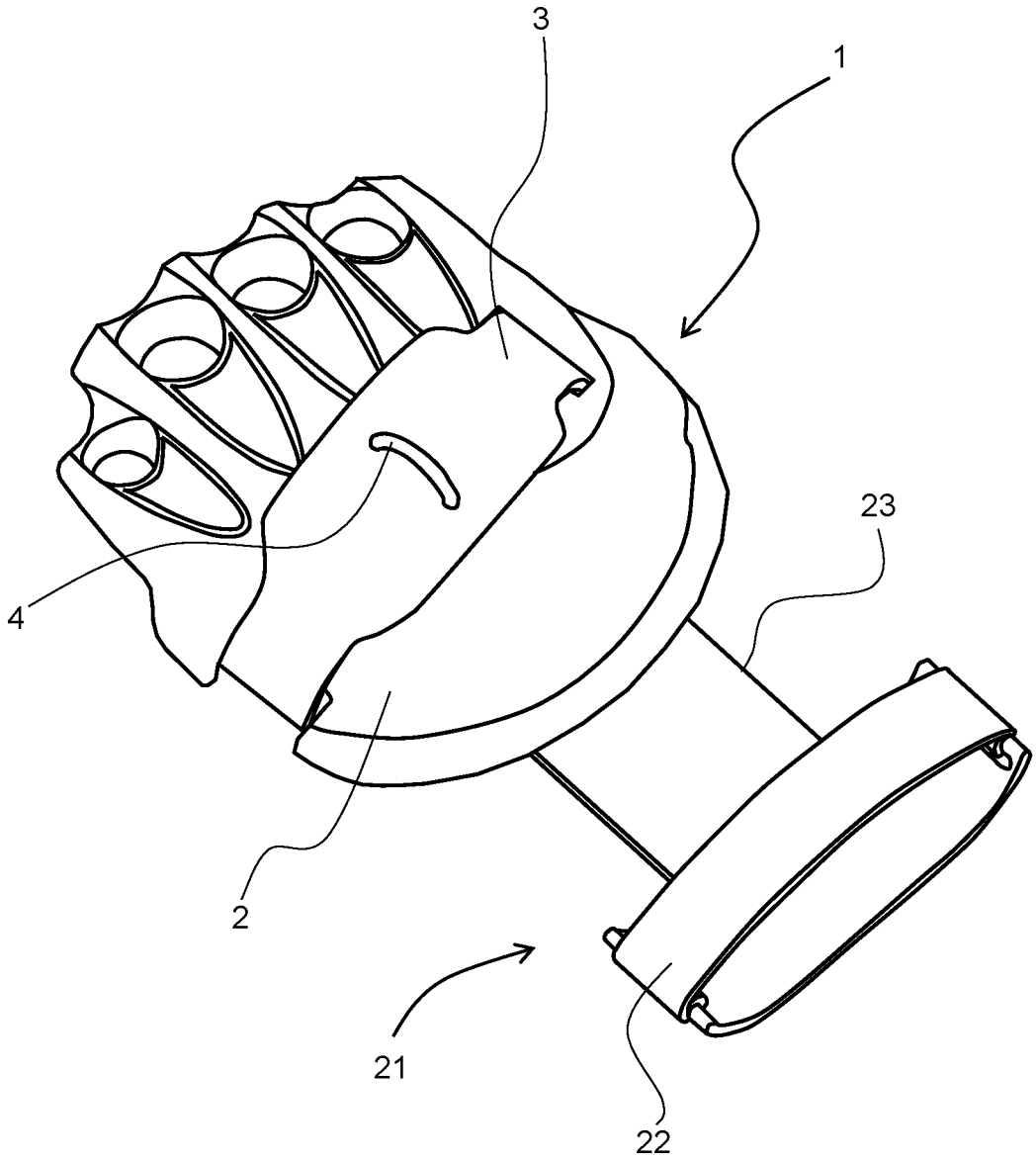

FIG. 6: shows an oblique view of the holding device 1 from FIG. 1 with a wrist support fastened thereto.

Figure 7:
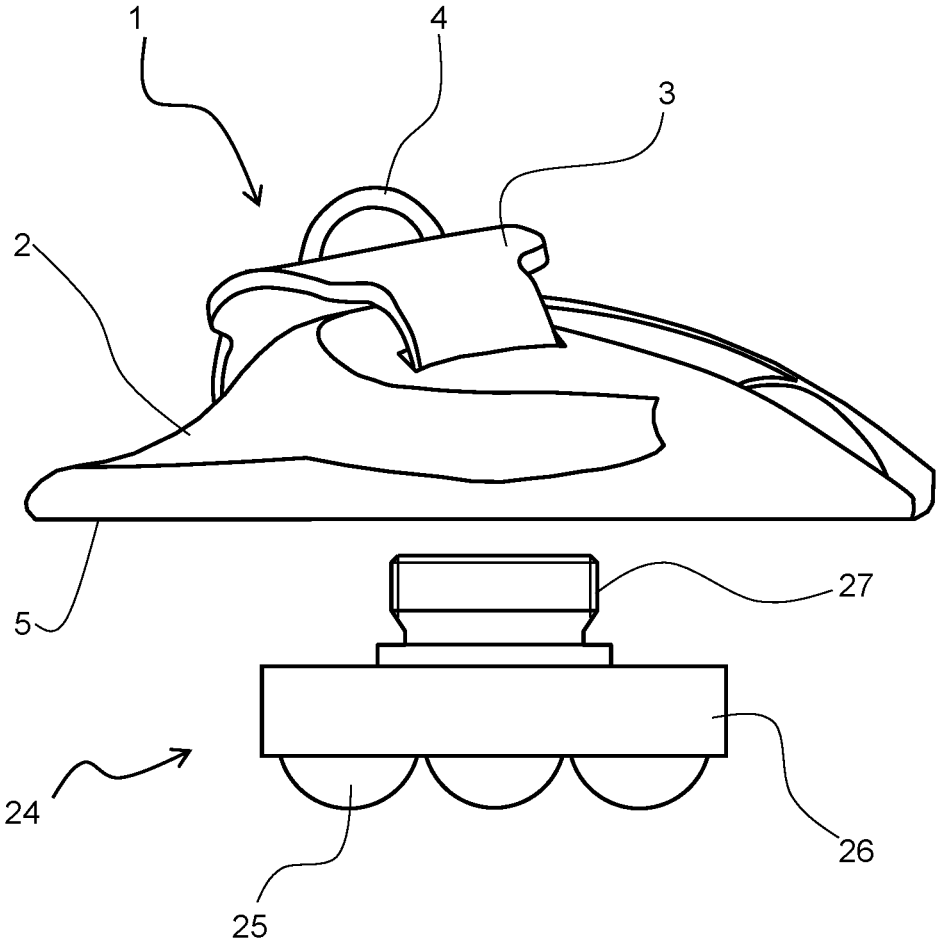

FIG. 7: shows an exploded side view of the holding device from FIG. 1 with a ball roller set fastened thereto.

Of the holding device 1 according to FIG. 1, the gripping part 2, the strap 3 and the loop 4 are visible.

The gripping part 2 is an at least approximately flat body, the surface of which can be subdivided roughly into two surface regions, namely what is known as an "underside" 5 (FIG. 3) and what is known as a "hand side" 6, which enclose the volume of the gripping part 2 between one another. (The naming does not mean that the underside 5 has to be located beneath the hand side 6.)

The underside 5 (FIG. 3) is typically configured in a substantially planar manner.

Broadly speaking, the hand side 6 is curved in a slightly convex manner. Parts of the hand side 6 are, in contrast to the otherwise convex curvature, configured as a channel or even an aperture.

The strap 3 is fastened to the gripping part 2 at two mutually spaced-apart fastening points 28 and a bridge 29 between these fastening points. The hand side 6 of the gripping part enables the palm region of a human hand to extend through between the strap 3 and hand side 6 and this rests with the palm on the hand side 6 and with the outside of the hand on the underside of the strap 3.

The strap 3 can be formed from a flexible textile or leather-like material or from a rigid material that is provided with cushioning on the side of the gripping part. In any case, the width of the opening between the strap 3 and gripping part 2 should be settable so as to be adaptable to hands of different sizes.

There are two fastening points 28 of the strap 3 are spaced apart from each other, and that the strap 3 is a bridge between these two fastening points 28 which, apart from the fastening points 28, extends at a distance 29 from the hand side 6 of the gripping part 2.

It is of significance according to the invention that the hand side 6 has four channel-like recesses 7 which, when the device is used as intended, extend parallel to the index finger, middle finger, ring finger and little finger of the hand resting on the gripping part 2 and are dimensioned and spaced apart from one another such that a respective one of these fingers fits in a respective one of these channel-like recesses 7.

Preferably, those surface regions of the channel-like recesses 7 on which said fingers rest are each provided with a surface coating 8 that promotes adhesive friction. The resting surfaces, located next to the strap 3, for the thumb and the ball of the thumb of the hand resting on the gripping part 2 are preferably also provided with such a surface coating 8 that promotes adhesive friction.

As a result of these surface coatings 8, the transmissibility of the abovementioned forces between the gripping part 2 and the hand of the person using the holding device 1 is improved further in a comfortable manner.

Preferably, the depth of the channel-like recesses 7 increases continuously from zero away from the side on which, when the device is used as intended, the bases of the fingers of a hand rest. Compared with a stepped increase, a larger contact region between fingers and gripping part is achieved in this way, resulting in a lower force per contact-surface region and greater contact comfort.

Particularly preferably, the channel-like recesses 7 each end, at their end located, as intended, away from the palm, in a hole-like recess 9, the respective boundary surface 10 of which that faces the rest of the longitudinal region of the respective channel-like recess 7 is oriented at least regionally at least approximately normally to the underside 5 of the gripping part 2.

As a result of this orientation of the boundary surfaces 10, the gripping part 2 can be grasped very readily by the hand of the person using it, and forces that are oriented toward the wrist can be transmitted extremely well from the hand to the gripping part 2.

The annular loop 4 is fastened on that side of the strap 3 that faces away from the gripping part 2, preferably in the central region of said strap 3. Typically, it is in the form of a steel ring. By way of this loop 4, the holding device 1 can be connected to a pulling means from the side of the strap 2—and therefore from the back of the hand of the person using the holding device. Usually, a snap hook is used here as a connecting link. Thus, the holding device 1 can also be used as a handle for using exercise equipment in which weights are moved by means of cables (usually known as "cable pulls"). Likewise, the holding device 1 can be connected to resistance bands via the loop 4. Resistance bands in this context are rubber-elastic bands that are cyclically tensioned and relaxed by muscle strength for training purposes.

FIG. 3 and FIG. 4 illustrate the holding of weight plates 11 with the aid of holding devices 1 according to the invention. The holding devices 1 are equipped to this end with a bolt stub 12 which is rigidly connected to the gripping part 2—for example by a screw connection—and protrudes from the central region of the underside 5 of the gripping part 2.

In the application according to FIG. 3, a person who is using the holding devices according to the invention as intended puts a respective hand between a respective strap 3 and the associated gripping part 2 and moves the two holding devices 1 fastened to their two hands up to the weight plate 11 such that the two bolt stubs 12 that each protrude from an underside of a gripping part 2 project from opposite sides into the central through-opening in the weight plate 11, and pushes the two holding devices 1 gently toward one another.

As long as the relative position of the holding devices 1 with respect to one another does not change any further, the weight plate 11 is held securely between the two holding devices 1 and can be moved in any manner together therewith. Typically, the weight plate 11 can then be moved up and down in the vertical plane of symmetry of the standing or sitting person's body, with the result that, for example, the persons' pectoral muscles are trained very well without their wrists being uncomfortably loaded.

According to an optional development of the invention, the respective—free—end faces, facing away from the gripping part 2, of the bolt stub 12 are configured in a permanently magnetic manner, such that the free end faces of the two bolt stubs 12 magnetically attract one another. In this way, it is easier to keep the holding device 1 on the weight plate 11.

According to an optional development of the invention, the respective—free—end faces, facing away from the gripping part 2, of the bolt stubs 12 are configured as parts that are releasably connectable to one another, for example as parts that are connected by a screw connection, latching connection or bayonet connection and fit together in a mutually complementary manner. In this way, the holding device 1 can be kept on the weight plate 11 in a particularly safe and thus comfortable manner.

FIG. 3 teaches the use of a holding device 1 according to the invention for holding weight plates 11 with only one hand and thus also with only one holding device 1. To this end, the holding device 1 comprises, in addition to the gripping part 2, the strap 3 and the bolt stub 12, an extension piece 13 and a counterholder 14.

On that end side of the bolt stub 12 that faces away from the gripping part 2, a threaded bore extends into the bolt stub 12, an extension piece 13 being screwed into said bore.

The extension piece 13 consists of a support part and a threaded bolt, which are preferably formed in one piece with one another. The support part has the external shape of a short profile piece, for example of a circular cylinder. It is designed to be able to be plugged into the central through-hole in a weight plate 11 such that the lateral surface of the central through-hole of the weight plate can rest on the lateral surface of the support part. The threaded bolt protrudes axially from one of the end sides of the support part. The threaded bolt of the extension piece 13 is able to be screwed into the threaded bore in the bolt stub 12.

From the second end side of the support part of the extension piece 13, a further threaded bore extends into the extension piece 13. A further threaded bolt, which may belong to a further extension piece 13 (not illustrated) or—as illustrated—to a counterholder 14, can be screwed into this further threaded bore The counterholder 14 comprises, in addition to the further threaded bolt, a further support part and an end part 15. The support part on the counterholder 14 is in turn designed to be able to be plugged into the central through-opening in a weight plate 11 such that the lateral surface of the central through-opening in the weight plate can rest on the lateral surface of the support part. The end part 15 has, at least in a direction normal to the axial direction of the support part, a larger dimension than the diameter of the central through-opening in a weight plate 11. It is intended to prevent the weight plate 11 from moving away from the gripping part 2.

The number of extension pieces 13 should be chosen depending on how many weight plates 11 are intended to be held in a row at the same time by the holding device 1 with their end sides against one another.

If only one weight plate 11 is intended to be held by only one holding device 1, an extension piece 13 does not need to be used. Once the weight plate 11 has been pushed onto the bolt stub 12 of the holding device 1, the threaded bolt of the counterholder 14 can be screwed directly into the threaded bore in the bolt stub 12.

FIG. 4 illustrates an exemplary embodiment of a releasable connection of an eyelet 16 to the holding device 1. The eyelet 16 has a ring-like region and a threaded bolt. The threaded bolt of the eyelet 16 is able to be screwed into a nut threaded bore at the free end of the bolt stub 12 connected to the gripping part 2. Optionally, the bolt stub 12 could also be omitted and the threaded bolt of the eyelet 16 also be screwed into a nut threaded bore directly on the underside 5 of the gripping part 2.

Just like they are able to be fastened to the abovementioned loop 4, cable pulls or resistance bands for gym exercises are again able to be fastened to the eyelet 16. In contrast to the fastening to the loop 4, in this case, the force application point with regard to the hand of the person using the holding device is located on the side of the palm and not on the side of the back of the hand—with the result that pulling forces oriented in the opposite direction are transmissible to the hand.

FIG. 5 shows an exemplary embodiment of the underside 5 of the gripping part 2.

It is readily apparent here that the hole-like recesses 9 are open toward the underside 5. Compared with a blind, downwardly closed embodiment of the recesses 9 (which is likewise possible), the embodiment as a through-opening is advantageous for space reasons and with regard to better accessibility for cleaning work.

As illustrated, it is advantageous for the hole-like recesses 9 to be separated by walls 17 toward the edges, located away from the wrist, of the underside 5 and hand side 6. Compared with a design without such walls 17, in which the hole-like recesses 9 are thus open toward the edge of said surfaces, resulting in a fork- or comb-like appearance, the risk of fingers being able to be trapped between the gripping part 2 and other objects is reduced.

Located centrally on the underside of the gripping part 2 is a threaded bore 18. Various auxiliary parts, for example the abovementioned parts of bolt stub 12 and eyelet 16, and yet other parts can be releasably fastened to said threaded bore 18 by being screwed in.

A further advantageous special feature on the underside 5 of the gripping part 2 is the recess 19. This recess 19 has the form of a straight slot with a flat bottom, into which the abovementioned threaded bore 18 opens. Toward the edge of the underside 5, which, when the device is used as intended, is located in the vicinity of that hand that is holding the gripping part 2, the upper region of the recess is covered by a bridge-like material region 20. Apart from the volume enclosed by this bridge-like material region 20, the recess 19 extends as far as the lateral edge of the gripping part and is open toward this edge.

The benefit of the recess 19 will be apparent from FIG. 6:

FIG. 6 shows an optional advantageous extension of the holding device 1 according to the invention with a wrist support 21, which comprises an adjustable ring body 22 and a connection strip 23.

As intended, the ring body 22 encircles the forearm of the person using the holding device just above the wrist. The connection strip 23 projects into the recess 19 on the underside 5 of the gripping part 2 to beyond the threaded bore 18 therein and is fixed there by means of a screw that passes through a bore in the connection strip.

The wrist support 21 serves to avoid loads on the wrist of the person using the holding device.

FIG. 7 shows a further example of an advantageous extension of the holding device 1. This extension is a roller set 24. The latter has rolling bodies 25 (balls or rollers), a bearing housing 26 in which the rolling bodies 25 are mounted in a rotatable manner, and a threaded bolt 27 with which the set is able to be releasably connected to the threaded bore 18 on the underside 5 of the gripping part 2. A person who is carrying in each case one holding device 1 equipped in this way on their two hands can therefore do push-ups for example on level ground, in which no horizontally oriented force components are transmitted to the underlying surface by the hands—with the result that coordination skills are intensively trained in addition to muscle strength.

Rather than the threaded connections mentioned for the various embodiment variants, it is also quite possible to use bayonet connections or else combinations of screw connections and bayonet connections. (In a combination of screw connection and bayonet connection, thread turns are removed from one or more peripheral regions; as a result, to be connected, screw and nut can be pushed axially one into the other over a number of thread turns and then fixed releasably together in that they are twisted a little relative to one another about the common thread axis.)

Rather than the abovementioned screw connections or bayonet connections, it is also readily possible to use latching connections. Latching connections in this context are plug connections that are secured together in that a latching protrusion on one part engages in a latching recess in the other part, wherein the engagement of protrusion and recess is supported by elastic preloading of supporting material regions. The latching connections are in this case optionally also able to be combined with screw connections or bayonet connections.

Since the gripping part 2 has the abovementioned channel-like recesses 7 according to the invention, the gripping part 2 is able to be grasped extremely readily in a comfortable and safe manner by a hand. Only on account of this good graspability is it appropriate to provide the abovementioned connection options for different items of gym equipment on the gripping part 2, because without this good graspability, exercises on the gym equipment would be possible only in a very unsatisfactory manner.

The invention claimed is:

1. A holding device for using gym equipment for the purpose of bodybuilding training, the holding device comprising a gripping part and a strap, wherein the volume of the gripping part is enclosed substantially between an underside and a hand side, wherein the hand side is a supporting surface configured for a hand of a person using the holding device, and is convexly curved with a palm region and four channel-like recesses extending away from the palm region, the recesses having local recesses and/or apertures adjacent the respective ends thereof, wherein the strap is fastened to the gripping part at two spaced-apart fastening points forming a bridge with a longitudinal region in between the hand side of the gripping part and the strap, wherein a fastening part for releasably fastening a weight plate is releasably fastenable to the underside of the gripping part, wherein:

the four channel-like recesses are dimensioned and spaced apart from one another such that, when the holding device is used, each finger, apart from the thumb, is configured to fit in a respective one of the channel-like recesses, and in a central longitudinal region of the strap, an annular loop is fastened, to which a snap hook is able to be clipped.

2. The holding device as claimed in claim 1, wherein the channel-like recesses have a depth which increases continuously from zero as the channel-like recesses extend away from the palm region.

3. The holding device as claimed in claim 1, wherein the channel-like recesses each has an end spaced away from the palm and has a hole-like recess extending through the gripping part to the underside, when the holding device is resting, without any other force acting on it, on a level horizontal surface.

4. The holding device as claimed in claim 3, wherein the hole-like recesses are open toward the underside of the gripping part.

5. The holding device as claimed in claim 3, wherein the hole-like recesses are each separated by a wall between the channel-like recesses.

6. The holding device as claimed in claim 1, wherein surface regions of the channel-like recesses, that are configured to engage fingers of a hand are provided with a surface coating configured to increase adhesive friction to human skin.

7. The holding device as claimed in claim 1, wherein an eyelet, to which a snap hook is able to be clipped, is releasably fastenable to the underside of the gripping part.

8. The holding device as claimed in claim 7, wherein a threaded bore extends into the gripping part in the central region of the underside of the gripping part, and to releasably fasten the eyelet, a wrist support, a roller set or fastening parts for weight plates, a threaded bolt is able to be screwed into the threaded bore.

9. The holding device as claimed in claim 1, wherein a wrist support is releasably fastenable to the underside of the gripping part.

10. The holding device as claimed in claim 1, wherein a roller set is releasably fastenable to the underside of the gripping part.

* * * * *